US008070534B2

(12) United States Patent
Makino et al.

(10) Patent No.: US 8,070,534 B2
(45) Date of Patent: Dec. 6, 2011

(54) ELECTRIC CONNECTION BLOCK

(75) Inventors: Kimitoshi Makino, Shizuoka (JP); Kazuhide Takahashi, Shizuoka (JP); Koki Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/314,993

(22) Filed: Dec. 19, 2008

(65) Prior Publication Data

US 2009/0163085 A1 Jun. 25, 2009

(30) Foreign Application Priority Data

Dec. 21, 2007 (JP) ..... 2007-329994

(51) Int. Cl.
*H01R 13/502* (2006.01)

(52) U.S. Cl. ..... 439/701; 439/949

(58) Field of Classification Search ..... 439/76.2, 439/701, 949
See application file for complete search history.

(56) References Cited

U.S. PATENT DOCUMENTS

| | | | | |
|---|---|---|---|---|
| 5,106,309 | A * | 4/1992 | Matsuoka et al. | 439/71 |
| 6,663,422 | B1 * | 12/2003 | Robinson et al. | 439/517 |
| 7,300,320 | B2 * | 11/2007 | Lee | 439/862 |
| 2003/0194887 | A1 * | 10/2003 | Minowa et al. | 439/76.2 |

FOREIGN PATENT DOCUMENTS

| | | | |
|---|---|---|---|
| CN | 2305774 | | 1/1999 |
| CN | 2305774 | Y | 1/1999 |
| CN | 1398019 | A | 2/2003 |
| JP | 2003-031324 | | 1/2003 |
| JP | 2003-217437 | | 7/2003 |
| JP | 2004-282908 | | 10/2004 |
| JP | 2006-187050 | | 7/2006 |
| JP | 2006-269107 | | 10/2006 |
| JP | 2006-333583 | | 12/2006 |
| JP | 2006333583 | A * | 12/2006 |

OTHER PUBLICATIONS

English translation of Republic of China Office Action of application 200810191037.1 dated Jun. 2, 2010.
Notification of the First Office Action for Chinese Application No. 200810191037.1 issued Jun. 2, 2010.

* cited by examiner

*Primary Examiner* — Tulsidas C Patel
*Assistant Examiner* — Travis Chambers
(74) *Attorney, Agent, or Firm* — Edwards Wildman Palmer LLP

(57) ABSTRACT

The electric connection block includes: a plurality of layers, each layer consisting of a plurality of terminals bent in an L-shape arranged in a line, each terminal having a first end portion for electric connection and a second end portion for connection to a circuit board; an electrically insulating terminal holder including receiving surfaces arranged in a stairs manner, each receiving surface placing a first section of the terminal thereon, and through holes each permitting a second section of the terminal to be inserted therein, the through hole being adjacent to the receiving surface; and a cover which includes hole parts each permitting the first section of the terminal to be inserted therein and joins the terminal holder.

5 Claims, 5 Drawing Sheets

ELECTRIC CONNECTION BLOCK

BACKGROUND OF THE INVENTION (1) Field of the Invention

The present invention relates to an electric connection block, in which terminals connecting an electrical component such as a fuse, a connector and so on to a circuit board are laminated and arranged in a plurality of layers.

(2) Description of the Related Art

FIG. 8 shows an example of circuit board assembly including a fuse block as a conventional electric connection block (see Japanese Patent Application Laid-Open No. 2006-333583).

A fuse block 77 includes: a fuse holder (i.e. block body) 78 made of electrically insulating resin; a plurality of L-shaped terminals 76, one end part of which is inserted in the fuse holder 78 and an opposite end part of which is soldered to a circuit board 73; a comb teeth-shaped busbar (not shown in the figure) made of metal inserted in the fuse holder 78; and a connector 80 for receiving power supply, which receives one side part of the busbar.

The fuse holder 78 mounts a plurality of blade-shaped fuses (not shown in the figure) in two steps up and down in parallel in a left-and-right direction. Corresponding to a pair of the terminals situated up and down of the fuse, respective tuning fork-shaped clamp terminal parts of the pair of the terminals situated up and down and a pair of the busbars situated up and down are received in receiving chambers 77*a* situated up and down. The connector 80 is connected to circuits of a battery power supply-side and of alternator power supply-side.

A circuit board assembly 71 includes: a circuit board 73 mounting various electronic components 72; the fuse block 77 connected to the front side of the circuit board 73 by the terminal 76; and a connector block 75 connected to both sides left and right of the circuit board 73 by a terminal 74. The circuit board 73 and each block 75, 77 are covered by a cover (not shown in the figure) made of electrically insulating resin situated up and down on a condition that an opening 75*a*, 77*a*-side of each block 75, 77 is exposed, thereby constructing a junction block.

Japanese Patent Application Laid-Open No. 2006-333583 described above shows an example in which a terminal holder is joined to the fuse holder 78 on a condition that L-shaped terminals 76 (instead of the busbars described above) are received in a terminal holder (not shown in the figure) made of electrically insulating resin in a plurality of steps. The circuit board 73 is provided with a copper layer (not shown in the figure) at a middle part thereof in a thickness direction.

FIG. 9 shows an example of a fuse block structure, in which clamp terminal parts 83-side of respective L-shaped terminals 82 is press-fit into and fixed to a horizontal hole part 81 of a fuse holder (i.e. block body) made of electrically insulating resin (for example, see Japanese Patent Application Laid-Open No. 2003-217437 as to the press-fitting of the terminal).

The hole part 81 is formed in a rectangular slit-shape. An electrically insulating part 84 of the block body is positioned between the respective hole parts 81. A projection 85 is provided at both sides of the terminal 82. The projection 85 is press-fit into the electrically insulating part 84 so as to prevent the terminal 82 from coming out.

Japanese Patent Application Laid-Open No. 2006-187050 discloses an example of a fuse block structure, in which a terminal is fixed to a fuse holder (i.e. block body) by insert molding instead of press-fitting. Japanese Patent Application Laid-Open No. 2004-282908 discloses an example of a fuse block structure, in which terminals (or busbars) are arranged on a wiring board per layer.

As for the fuse block (shown in FIG. 8) described in Japanese Patent Application Laid-Open No. 2006-333583, it is demanded that the terminals 76 are correctly positioned with respect to the fuse and the circuit board 73 while the terminals 76 are received in a terminal holder (not shown in the figure) in a plurality of steps and that the terminals 76 of the respective steps are assembled to the terminal holder securely with good workability.

As for the fuse block (shown in FIG. 9) described in Japanese Patent Application Laid-Open No. 2003-217437, there is a possibility that when a pitch between the terminals 82 is made small, the electrically insulating part 84 between the terminals 82 becomes thin, causing deterioration in press-fitting property of the terminals and in electrical insulating property between the terminals.

As for the fuse block (not shown in the figure) described in Japanese Patent Application Laid-Open No. 2006-187050, there is a problem that it is difficult to insert-mold the terminals simultaneously in two or more layers.

As for the fuse block (not shown in the figure) described in Japanese Patent Application Laid-Open No. 2004-282908, there is a possibility that when the terminals are arranged on a wiring board per layer, the number of components is increased, a structure of the fuse block becomes large, an accuracy of dimension between the terminals is deteriorated, and assembling property (connection property) between the fuse block and another component such as a fuse or a circuit board is deteriorated.

The problem or undesirable possibility described above may similarly take place even when an electrical component such as fusible link or a relay is used instead of a fuse and even when a connector is being connected instead of an electrical component.

SUMMARY OF THE INVENTION

It is therefore an objective of the present invention to solve the above problems and to provide an electric connection block, by which terminals can be securely assembled to a terminal holder (i.e. block body) made of electrically insulating resin into a plurality of steps with good positioning accuracy without press-fitting or insert-molding the terminal.

In order to attain the above objective, the present invention is to provide an electric connection block including:

a plurality of layers, each said layer consisting of a plurality of terminals bent in an L-shape arranged in a line, each said terminal having a first end portion for electric connection and a second end portion for connection to a circuit board;

an electrically insulating terminal holder including receiving surfaces arranged in a stairs manner, each said receiving surface placing a first section of the terminal thereon, and through holes each permitting a second section of the terminal to be inserted therein, said through hole being adjacent to the receiving surface; and a cover which includes hole parts each permitting the first section of the terminal to be inserted therein and joins the terminal holder.

With the construction described above, the second end portions of the terminals of the respective layers are inserted in the respective through holes of the terminal holder and the first end portions of the terminals of the respective layers are placed on the respective receiving surfaces of the terminal holder. Then, the cover is assembled to the terminal holder and the first end portions for electric connection are inserted in the respective hole parts of the cover so as to project to the outside. The cover prevents the terminals of the respective layers from coming out from the terminal holder. The through holes position the respective second sections of the terminals, so that the second sections of the terminals can be smoothly securely inserted into respective through holes of a circuit board. The hole parts of the cover position the first end portions for electric connection of the terminals of the respective layers, so that the first end portions can be smoothly securely connected to respective terminals of electric components such as fuses or relays and to respective terminals of connectors.

With the construction described above, since the terminals of the respective layers can be inserted into the respective through holes of the terminal holder without using press-fitting or insert molding, therefore the assembly of the terminals to the terminal holder can be carried out by hands as wall as by an automatic machine. Moreover, since positioning or alignment of the first and second end portions of the terminals of the respective layers can be correctly performed by assembling the terminals of the respective layers to the terminal holder and by mounting the cover to the terminal holder, therefore the terminals can be smoothly securely connected to electric components such as fuses or relays and to connectors.

The receiving surface is partitioned by partition walls of the terminal holder, a rib is formed crossing the partition wall at a front end of the partition wall, and the first section of the terminal is provided with a concave groove or hole which engages with the rib.

With the construction described above, the terminals of the respective layers are smoothly assembled to the terminal holder along the respective partition walls, the first sections of the terminals are electrically insulated by the respective partition walls of the terminal holder so as to prevent a short circuit between the adjacent terminals from occurring. Since the rib of the partition wall engages with the corresponding concave groove or hole of the terminal, therefore the rib absorbs pressing force or pulling force of the terminal generated when terminals of electric components such as fuses or of connectors are being decoupled therefrom, so that propagation of force of the mating terminals to the second end portions for connection to a circuit board of the terminals (i.e. propagation of force of the mating terminals to a solder-connecting part to a circuit board) is prevented from occurring so as to prevent a stress load to a connecting part to the circuit board from occurring. In this specification, the side of the electric component such as the fuse is defined as the "front" side.

The through hole of the terminal holder and/or the hole part of the cover is formed in a tapered shape so as to gradually become narrow in an insertion direction of the terminal.

With the construction described above, the second sections of the terminals of the respective layers can be smoothly simply inserted from a wide entrance of the respective through holes of the layers of the terminal holder, and alignment of the second end portions are correctly performed by a narrow exit of the respective through holes upon the insertion. Likewise, the first sections of the terminals of the respective layers can be smoothly simply inserted from a wide entrance of the respective hole parts of the cover, and alignment of the first end portions are correctly performed by a narrow exit of the respective hole parts upon the insertion. Accordingly, both of assembling workability and electric connection property of the terminals can be improved.

A rib, which continues to a partition situated between the hole parts of the cover, engages with a groove part situated at a front end of the rib of the terminal holder.

With the construction described above, when the terminals of the respective layers are assembled to the terminal holder and the cover is assembled to the terminal holder, the partitions of the cover match with the respective partition walls of the terminal holder so as to attain excellent electrical insulation between the terminals. Since the rear ends of the partitions of the cover engages with the respective ribs of the terminal holder, therefore the cover and terminal holder are mutually positioned so as to alignment of the first and second end portions of the terminals of the respective layers can be correctly carried out.

With the construction described above, since the ribs of the cover engage with the respective groove parts of the ribs of the terminal holder, therefore the cover and terminal holder are mutually positioned so as to alignment of the first and second end portions of the terminals of the respective layers can be correctly carried out, so that electric connection property between the circuit board and the electric components such as fuses or connectors is improved.

The first end portions of the terminals are assembled to the terminal holder on a condition that the first end portions are linked by a link belt per layer, and the cover is assembled to the terminal holder on a condition that the link belt is cut.

With the construction described above, the terminals arranged in a line of the respective layers are linked and integrated by the link belt and are simultaneously assembled to the terminal holder per layer on such a condition. That is, the second sections of the terminals are inserted into the respective through holes, and the first sections of the terminals are placed on the respective receiving surfaces. Thereafter, the link belt is cut and removed, and the cover is assembled to the terminal holder while the first end portions of the terminals are inserted into the respective hole parts of the cover.

With the construction described above, since the terminals can be simultaneously assembled to the terminal holder per layer, therefore man-hour for assembling of the terminals to the terminal holder can be reduced and productivity of the electric connection block can be improved.

DESCRIPTION OF THE PREFERRED EMBODIMENTS

FIGS. 1-7 show a preferred embodiment of a fuse block as an example of an electric connection block according to the present invention.

Figure 1:
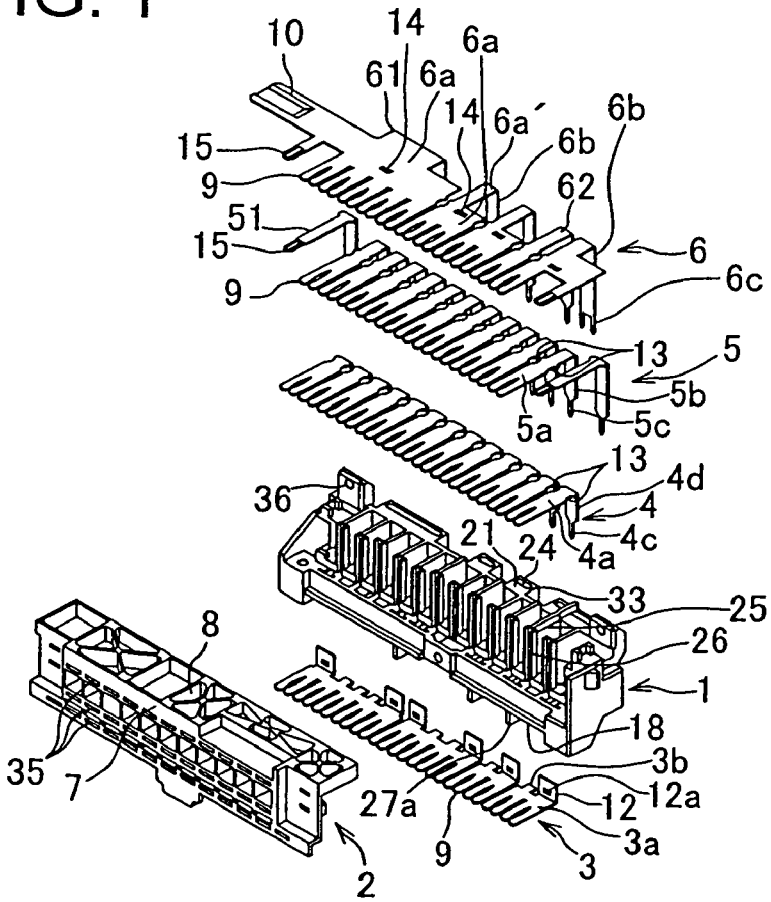
FIG. 1 is an exploded perspective view illustrating a preferred embodiment of an electric connection block according to the present invention.

As shown in FIG. 1, the fuse block (i.e. electric connection block) includes: a terminal holder (i.e. a first block body) 1 made of electrically insulating resin; terminal groups 4-6 which are inserted into the terminal holder 1 perpendicularly from above in plural stairs (three stairs in this example), each terminal being bent in an L-shape; a terminal group 3 for jointing situated at the lowest layer, which is inserted into the terminal holder 1 from below; and a cover (i.e. a second block body) 2 made of electrically insulating resin, which is mounted on the terminal holder 1 from the front on a condition that the terminal groups 3-6 are piled up and placed on the terminal holder 1.

Figure 2:
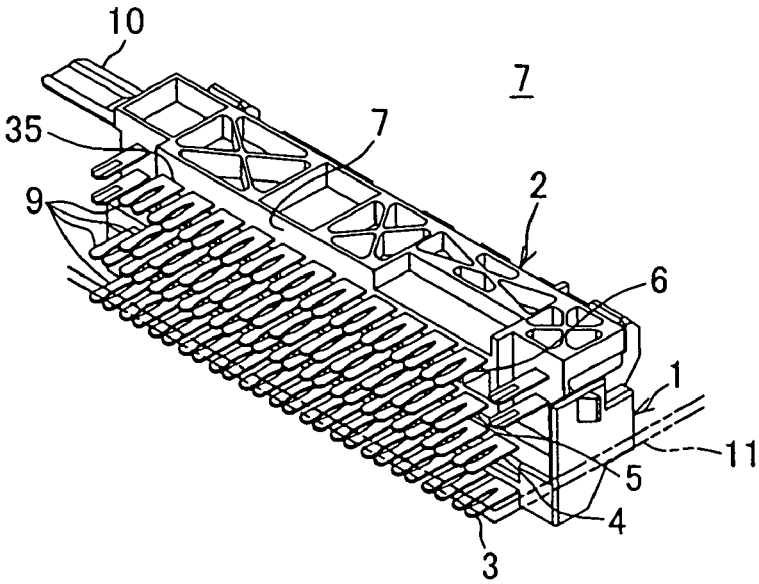
FIG. 2 is a perspective view illustrating an assembled electric connection block.

As shown in FIG. 2, in an assembled state of a fuse block 7, the cover 2 is situated in front of and above the terminal holder 1, and each clamping end portion (i.e. first end portion) 9 for fuse connection (i.e. for electric connection) of the corresponding terminal (hereinafter, indicated by 3-6) of a corresponding layer of the terminals projects horizontally from a front wall 7 of the cover 2 (see FIG. 6). A tab-shaped terminal part 10 for receiving power supply projects laterally from a terminal 61 (FIG. 1) situated at the left end of the most upper layer.

The clamping end portions 9 of the terminals 3-6 constructing four layers face each other up and down. A tab-shaped of up and down of a blade-shaped fuse (not shown in the figure) situated at the first step is inserted into the corresponding clamping end portion 9 of the terminal 3 and 4, which constructs the first layer and the second layer, respectively. A tab-shaped of up and down of a fuse (not shown in the figure) situated at the second step is inserted into the corresponding clamping end portion 9 of the terminal 5 and 6, which constructs the third layer and the fourth layer, respectively. A reference numeral 11 in FIG. 2 denotes a circuit board having an electrically conductive metal core layer at the middle thereof in a thickness direction thereof.

As shown in FIG. 1, the terminals 3 of the first layer include: a plurality of the clamping end portions 9 extending horizontally lined up laterally on a front side of a horizontal plate part 3*a*; fixing pieces 12 rising up from a base end of the horizontal plate part 3*a*; and pin-shaped terminal parts 3*b* for connecting a circuit board thereto. Each fixing piece 12 includes a projection 12*a* for press-fitting in a thickness and/or width direction of the plate.

Each terminal 4 of the second layer is formed being bent in an L-shape and includes: a clamping end portion (i.e. first end portion) 9 situated at a front side of a horizontal plate part (i.e. first section) 4*a*; and a pin-shaped terminal part (i.e. second end portion) 4*c* for connecting a circuit board thereto situated at a front side (lower side) of a perpendicular plate part (i.e. second section) 4*b*. The horizontal plate part 4*a* has concave grooves 13 notched perpendicularly in a rectangle shape at both sides in a plate-width direction of the horizontal plate part 4*a* in the vicinity of a bent part 4*d*. The horizontal plate part 4*a* is formed longer than the horizontal plate part 3*a* of the terminal 3 of the first layer. The perpendicular plate part 4*b* including the pin-shaped terminal part 4*c* projects longer than the pin-shaped terminal part 3*b* of the terminal 3 of the first layer.

Each terminal 5 of the third layer is also bent in an L-shape similarly to the terminal 4 of the second layer and includes: a clamping end portion (i.e. first end portion) 9 and rectangular shaped concave grooves 13 on a horizontal plate part (i.e. first section) 5*a* thereof; and a pin-shaped terminal part (i.e. second end portion) 5*c* for connecting a circuit board thereto situated at an end of a perpendicular plate part (i.e. second section) 5*b*. The horizontal plate part 5*a* is formed longer than the horizontal plate part 4*a* of the terminal 4 of the second layer. The perpendicular plate part 5*b* is formed longer than the perpendicular plate part 4*b* of the terminal 4 of the second layer. A distance from an end of the clamping end portion 9 to the concave groove 13 is set equal to a distance from an end of the clamping end portion 9 to the concave groove 13 of the terminal 4 of the second layer. Terminals 51 situated at both ends at left and right of the third layer are not the clamping end portions 9 and instead, include tab-shaped terminal parts 5*a*1 for fusible link connection (i.e. electric connection). The horizontal plate parts 4*a* and 5*a* of the terminals 4 and 5 of the second and third layers, respectively, become narrow in their width at the rear of the respective concave grooves 13 and continue to respective perpendicular plate parts 4*b* and 5*b*.

Each terminal 6 of the fourth layer mainly includes a plurality of clamping end portions 9 lined up in parallel on a horizontal wide plate part (i.e. first section) 6*a* (in the example shown in the figure, a terminal indicated by a reference numeral 62 having one clamping end portion 9) and integrally includes narrow plate parts 6*a*' at a base end of the horizontal plate part 6*a*. The narrow plate part 6*a*' is bent in an L-shape and continues to a perpendicular plate part (i.e. second section) 6*b*. Each terminal 6 also includes a pin-shaped terminal part (i.e. second end portion) 6*c* for connecting a circuit board thereto situated at an end (lower end) of the perpendicular plate part 6*b*. The horizontal plate part 6*a* includes a rectangular hole part 14. A distance from an end of the clamping end portion 9 to the hole part 14 is set equal to a distance from an end of the clamping end portion 9 to the concave groove 13 of the terminal 4 or 5 of the second or third layer, respectively. A horizontal plate part 6*a* of the terminal 61 situated at a left end is provided with a tab-shaped terminal part 10 for receiving power supply in a lateral direction. The terminals situated both sides left and right are provided with respective tab-shaped terminal parts 15 for fusible link connection.

Figure 3:
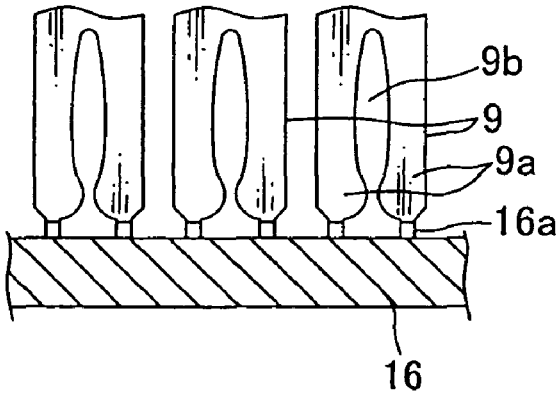
FIG. 3 is a plan view illustrating an example of a linked structure of terminals.

As shown in FIG. 3, in each terminal 3-6, the ends of the clamping end portions 9 are integrally linked together with a lateral horizontal link belt (carrier) 16. The link belt 16 continues to the clamping end portions 9 through respective narrow width parts 16*a*, each of which crosses at right angles the link belt 16. As shown in FIG. 3, the narrow width parts 16*a* of the link belt 16 are bent and cut on a condition that the terminals 3-6 of the respective layers are inserted in the terminal holder 1. The clamping end portion 9 includes a pair of resilient contact pieces 9*a* and an insertion gap 9*b* between the resilient contact pieces 9*a*.

Figure 4:
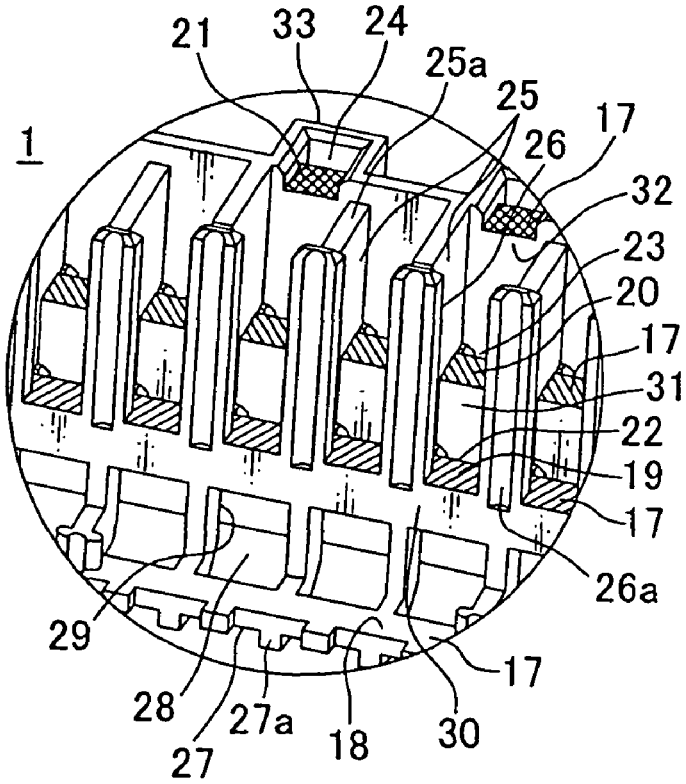
FIG. 4 is a perspective view of a primary part illustrating an inner structure of a terminal holder shown in FIG. 1.

As shown in FIG. 4, the terminal holder 1 shown in FIG. 1 includes: stair-shaped portions 17; through holes 22-24 for inserting the terminals formed at a rear side of respective stair-shaped horizontal wall parts (i.e. receiving surfaces) 19-21; perpendicular partition walls 25 partitioning the respective through holes 22-24; and T-shaped crossing ribs 26 formed integrally with respective front ends of the partition walls 25.

The horizontal wall parts 19 of the second layer are positioned parallel to each other on a different stair at the rear upper side of the horizontal wall parts 18 of the first layer. The horizontal wall parts 20 of the third layer are positioned parallel to each other on a different stair at the rear upper side of the horizontal wall parts 19 of the second layer. The horizontal wall parts 21 of the fourth layer are positioned parallel to each other on a different stair at respective predetermined positions at the rear upper side of the horizontal wall parts 20 of the third layer.

A back surface (lower surface) of the horizontal wall parts 18 of the first layer is provided with terminal receiving grooves 27 partitioned by ribs 27*a*. In an example shown in FIG. 4, each terminal receiving groove 27 continues to a corresponding perpendicular opening 28 situated at the rear. Each clamping end portion 9 of the terminal 3 of the first layer is arranged in the corresponding terminal receiving groove 27. The perpendicular fixing piece 12 (see FIG. 1) of the terminal 3 of the first layer is upwardly inserted into and engaged with a corresponding fitting groove 29 within the opening 28.

Although the terminal holder 1 shown in FIG. 4 looks a little different from that shown in FIG. 1 as to the first layer, they are basically the same with each other. The terminal holder 1 shown in FIG. 4 is applicable to a case in which the terminals 3 of the first layer are independent from each other. A horizontal wall part 18 of the terminal holder 1 shown in FIG. 1 is provided with a rib-shaped partition wall 27*a* for electrical insulation partitioning the terminals 3 of the first layer.

In FIG. 4, the horizontal wall part 18 of the first layer continues to perpendicular wall part 30 of the second layer situated at the rear crossing at right angles the perpendicular wall part 30. The perpendicular wall part 30 of the second layer continues to horizontal wall part 19 of the second layer crossing at right angles the horizontal wall part 19. A perpendicular wall part 31 of the third layer is positioned between the horizontal wall parts 19 and 20 of the second and third layers, respectively. A through hole 22 for inserting the terminal is provided between the perpendicular wall part 31 of the third layer and the horizontal wall part 19 of the second layer. That is, The through hole 22 for inserting the perpendicular plate part 4*b* of the terminal 4 of the second layer is provided at the rear of the horizontal wall part 19 of the second layer.

The through hole 22 continues to a perpendicular wall part 31 of the third layer situated at the rear. The rear of the horizontal wall part 20 of the third layer is provided with a through hole 23 for inserting a perpendicular plate part 5*b* of the terminal 5 of the third layer. The through hole 23 continues to a perpendicular wall part 32 of the fourth layer situated at the rear. A predetermined position at the upper rear of the perpendicular wall part 32 of the fourth layer is provided with a horizontal wall part 21 of the fourth layer crossing at right angles. The rear of the horizontal wall part 21 of the fourth layer is provided with a through hole 24 for inserting a perpendicular plate part 6*b* of the terminal 6 of the fourth layer. The through hole 24 is surrounded by a perpendicular frame-shaped wall part 33. The frame-shaped wall part 33 projects upward a little higher than the horizontal wall part 21 of the fourth layer, acts as an electrical insulating partition wall, and continues to the rear surface side of the perpendicular wall part 32 of the fourth layer crossing at right angles.

Figure 6:
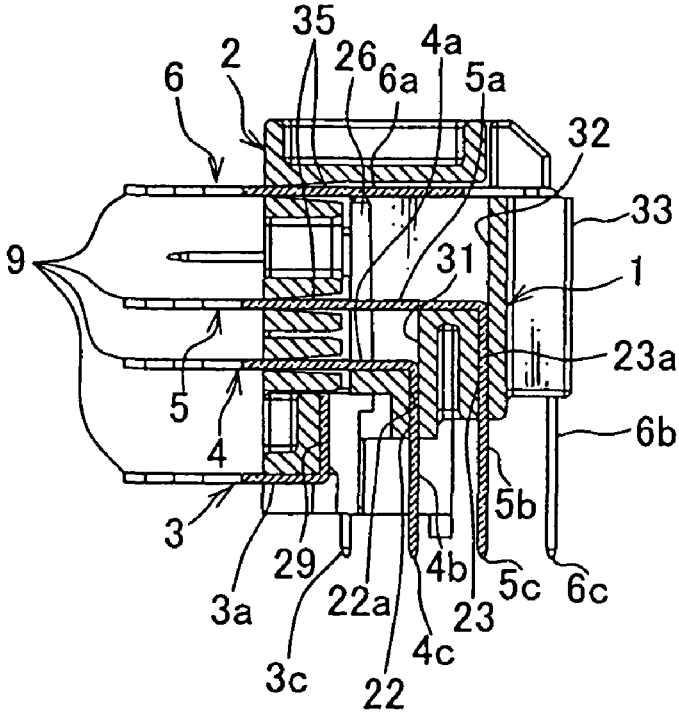
FIG. 6 is a longitudinal cross sectional view taken along A-A line in FIG. 5.

As shown in FIG. 6, upper surfaces of the horizontal wall parts 19-21 of the second to fourth layers, respectively, act as respective support surfaces, which receive respective back surfaces (lower surfaces) of the horizontal plate parts 4*a*-6*a* of the terminals 4-6 of the second to fourth layers, respectively. The horizontal plate parts 4*a*-6*a* of the terminals 4-6 of the respective layers are correctly positioned and stably held by the support surfaces (hereinafter, indicated by 19-21), so that positions (alignment) of the clamping end portions 9 of the terminals 4-6 are correctly defined.

Figure 7:
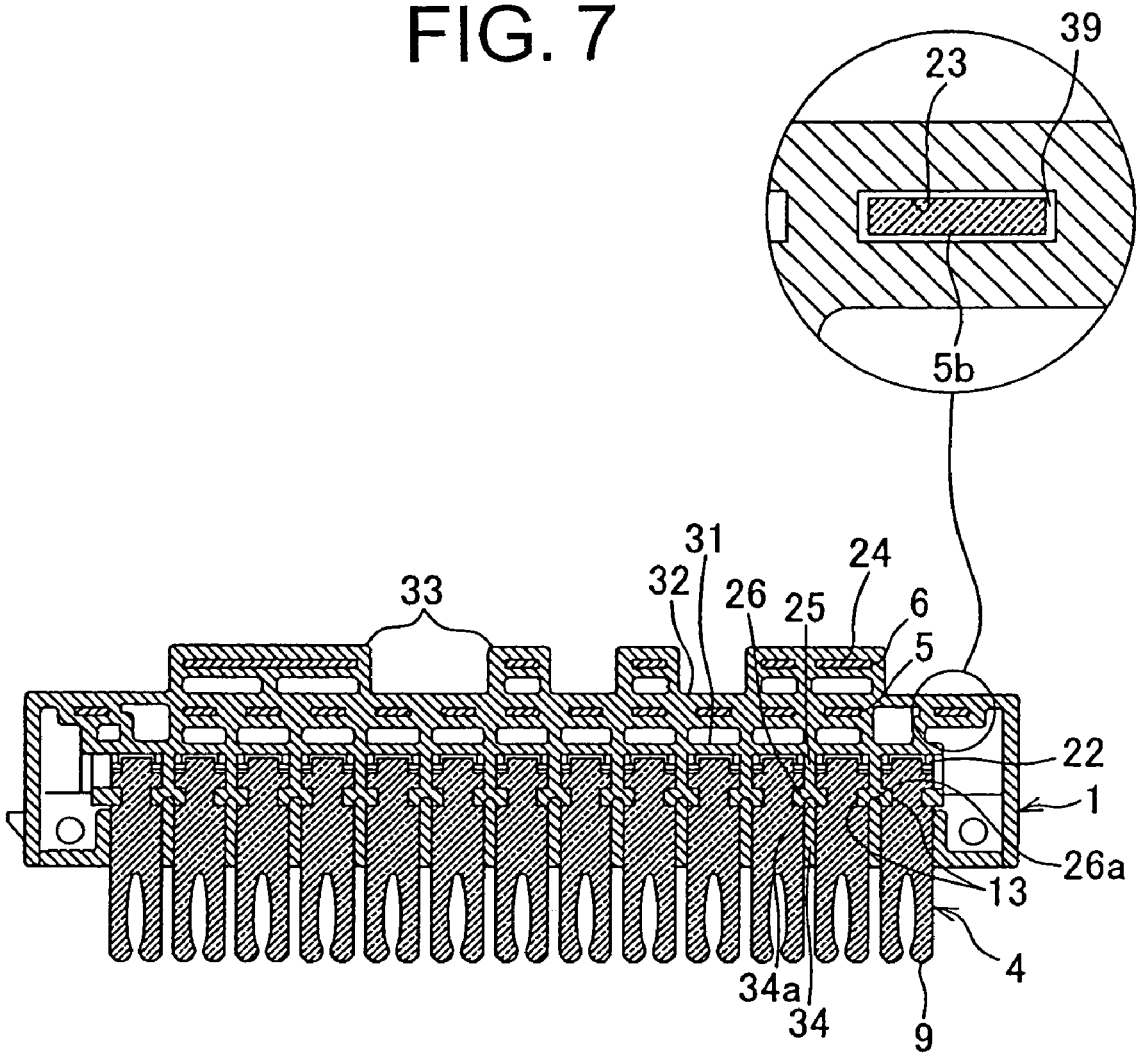
FIG. 7 is a lateral cross sectional view taken along B-B line in FIG. 5.

As shown in FIGS. 6 and 7, the perpendicular plate parts 4*a*-6*a* of the terminals 4-6 of the second to fourth layers, respectively, are inserted into the through holes 22-24 of the respective layers from above, so that positions (alignment) of the pin-shaped terminal parts 4*c*-6*c* for connecting a circuit board thereto of the respective terminals 4-6 are correctly defined. Each of the through holes 22-24 is formed gradually narrow in width thereof in a tapered shape from up to down so that the plate parts 4*b*-6*b* of the terminals 4-6 can be easily inserted therein and correctly positioned.

The perpendicular wall surfaces 31, 32 of the third and fourth layer and the perpendicular rear wall surface of the frame-shaped wall part 33 act as receiving surfaces receiving the perpendicular plate parts 4*b*-6*b* of the terminals 4-6 of the second to fourth layer upon inserting (connecting) a fuse (i.e. electric component) as rear end surfaces of the through holes 22-24. The perpendicular front end surfaces 22*a*-24*a* of the through holes 22-24 act as receiving surfaces receiving the perpendicular plate parts 4*b*-6*b* of the terminals 4-6 of the second to fourth layer upon releasing (removal of connection of) a fuse (i.e. electric component). The ribs 26 situated at the front end crossing the partition wall 25 at right angles in a T-shape (see FIG. 4) also act as a receiving surfaces of the respective terminals 4-6. Pressing force upon release of the fuse is received by the respective receiving surfaces described above, so that force propagation of the terminals 4-6 and the circuit board 11 (see FIG. 1) to a solder connecting portion is prevented from occurring and electrical connection characteristic of the solder connecting portion is excellently secured.

In the perpendicular partition walls 25 (see FIG. 4), upper end surfaces 25*a*, on which the terminals 6 of the fourth layer are placed, is arranged a little lower. The horizontal plate part 6*a* of the terminal 6 of the fourth layer is positioned inside the partition walls 25. As shown in FIG. 7, the ribs 26 situated at the front ends of the respective partition walls 25 engage with the respective concave grooves 13 situated at both sides of the terminals 4 and 5 of the second and third layer and also engage with the respective holes 14 (see FIG. 1) of the terminals 6 of the fourth layer so as to correctly perform the positioning of the terminals 4-6 and to receive the force upon release of the fuse.

The rib 26 situated at the front end of the partition wall 25 has a perpendicular groove part 26*a* (see FIG. 4) at the front end thereof. The groove part 26*a* engages with a perpendicular rib 34*a* (see FIG. 7) on an inner surface of the front wall 7 of the cover 2 (see FIG. 1). Thereby, the positions (alignment) of the clamping end portions 9 of the terminals 4-6 of the respective layers projecting from respective horizontal rectangular slit-shaped hole parts 35 of the cover 2 are correctly defined. The ribs 34*a* (see FIG. 7) of the cover 2 are arranged at both sides left and right of the respective hole parts 35.

As shown in FIG. 1, the cover 2 is formed in an L-shape in longitudinal section thereof by an upper horizontal wall part 8 and a front perpendicular wall part 7. The front wall part 7 includes the clamping end portions 9 of the terminals 4-6 of the second to fourth layers and the hole parts 35 for inserting the tab-shaped terminal parts 15 therein. As shown in FIG. 6, the hole part 35 of the cover 2 is formed gradually narrow in width thereof in a tapered shape from the rear end to the front end, similarly to the through holes 22-24 of the terminal holder 1, so that the clamping end portion 9 and the tab-shaped terminal part 15 are smoothly inserted into the hole part 35 and correctly positioned. The upper wall part 8 of the cover 2 covers the terminals 6 situated at the upper layer and an upper portion of the through holes 22-24 of the terminal holder 1 so as to prevent dust from entering from the outside. As shown in FIG. 1, the terminal holder 1 has positioning holes 36 at three positions back and forth. The cover 2 has a positioning projection (not shown in the figure) which engages with the positioning hole 36.

Figure 5:
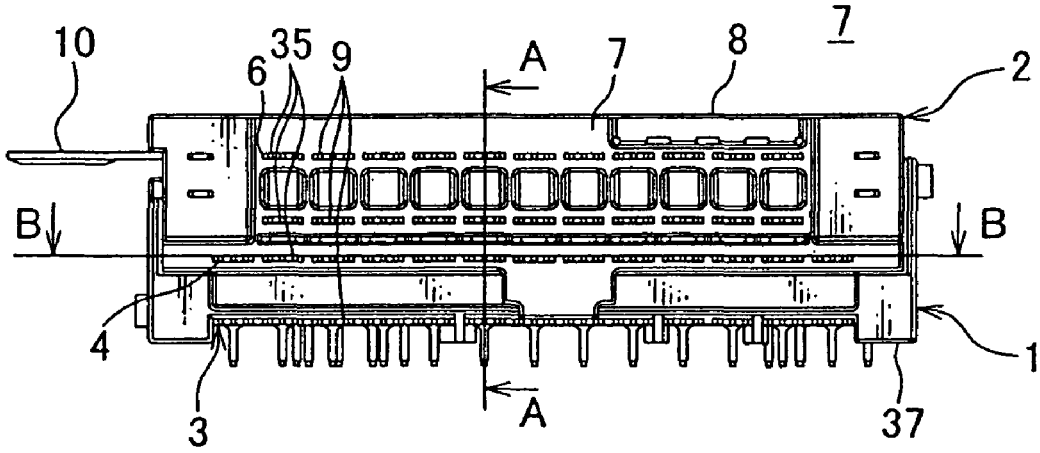
FIG. 5 is a front view illustrating an assembled electric connection block.

FIG. 5 is a front view illustrating an fuse block 7 viewed from the front surface side of the cover 2. FIG. 6 is a longitudinal cross sectional view taken along A-A line in FIG. 5. The pin-shaped terminal parts 3*c*-6*c* situated at a lower end side of the terminals 3-6 of the respective layers project downward lower than lower end surfaces 37 situated at both sides left and right of the terminal holder 1. An upper surface of the circuit board (see FIG. 1) abuts against the lower end surface 37 of the terminal holder 1 while the respective pin-shaped terminal parts 3*c*-6*c* are inserted in through holes (not shown in the figure) of the circuit board 11 and connected by soldering. Some of the through holes are connected to a metal core layer (not shown in the figure) situated in the middle of the circuit board 11. The other through holes are connected to a printed circuit board (not shown in the figure) situated on a front surface or a back surface of the circuit board 11.

Figure 8:
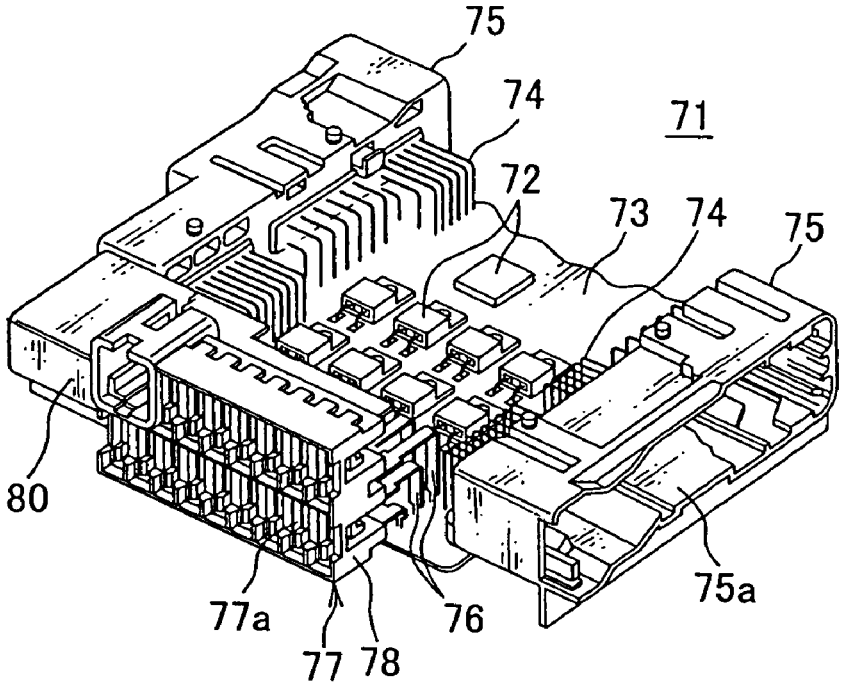
FIG. 8 PRIOR ART
FIG. 8 is a perspective view illustrating a circuit board assembly including an example of a conventional electric connection block.
Figure 9:
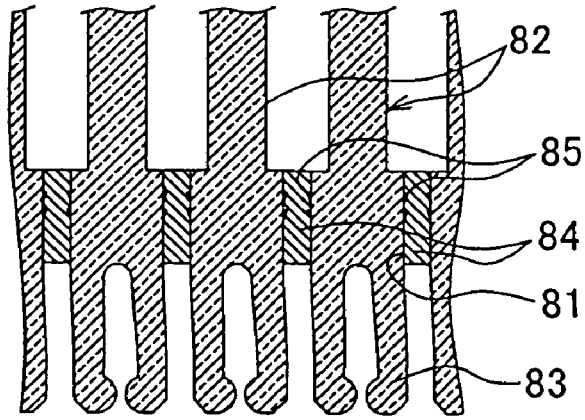
FIG. 9 PRIOR ART
FIG. 9 is a lateral cross sectional view illustrating an example of a fixing structure of terminals of a conventional electric connection block.

A fuse holder (not shown in the figure) made of electrically insulating resin is welded to and locked to the terminal holder 1 from the front side of the cover 2, each clamping end portion 9 of the terminals 3-6 projects into each fuse receiving chamber of the fuse holder, and the fuse (not shown in the figure) is horizontally inserted into the fuse receiving chamber from the front, so that a tab terminal of each fuse is connected to the corresponding clamping end portion 9. An arrangement of the fuse block to the circuit board 11 and an arrangement of a connector block (not shown in the figure) are similar to those shown in FIG. 8.

FIG. 7 is a lateral cross sectional view taken along B-B line in FIG. 5, illustrating a state when the terminals 4 of the second layer are seen from above. The perpendicular plate part 5*b* of the terminals 5 of the third layer and the perpendicular plate part 6*b* of the terminals 6 of the fourth layer are shown with their sections. The horizontal plate parts 4*a*-6*a* of the terminals 4-6 are partitioned and electrically insulated from each other by the partition wall 25 of the terminal holder 1 and the front partition wall 34 of the cover 2, the concave groove 13 of the horizontal plate part of the terminals 4 and 5 engages with the perpendicular rib 26 situated at the front end of the partition wall 25 so as to be positioned, the rib 26 can receive the fuse releasing force, and the rib 34*a* situated at the rear end of the partition wall 34 of the cover 2 engages with the groove part 26*a* of the rib 26 of the terminal holder 1 so as to be positioned.

The terminals 4 and 5 of the second and third layers are arranged in parallel having the same pitch, and the perpendicular plate parts 6*b* of the terminal 6 of the fourth layer are arranged in parallel with different pitches from each other. The perpendicular plate parts 4*b*-6*b* of the terminals 4-6 are inserted in between the respective through holes 22-24, shown in lateral cross sectional view FIG. 7, having a little gap between the inner surface of the through holes 22-24 and the corresponding plate part 4*b*-6*b*. A similar gap is given in a case of the hole parts 35 of the cover 2.

When the link belt 16 shown in FIG. 3 is used, the link belts 16 are cut in turn starting from the terminals 3 of the lowest layer or from the terminals 6 of the highest layer on a condition that the terminals 3-6 of the respective layers are assembled to the link belt 16 in FIG. 6, then the cover 2 is assembled to the terminal holder 1, that is, the clamping end portions 9 of the terminals 3-6 of the respective layers are inserted into the respective hole parts 35 of the cover 2, so that positioning projection (not shown in the figure) of the cover 2 is engaged with the positioning hole 36 (see FIG. 1). By this engagement between the positioning means, locking means between the cover 2 and the terminal holder 1 is not necessary. The cover 2 prevents the terminals 3-6 of the respective layers from coming out from the terminal holder 1. The cutting of the link belt 16 described above may also be effective as a method of assembling a fuse block (i.e. electric connection block) 7.

The terminals 3 of the lowest layer are press-fit from below and assembled to the terminal holder 1 in an inverse manner to the case of the terminals 4-6 of the other layers. However, instead, the terminals 3 of the lowest layer may be press-fit from above and assembled to the terminal holder 1 in the same manner as the case of the terminals 4-6 of the other layers. In such a case, a horizontal wall part for receiving the horizontal plate part of the terminal of the first layer (i.e. the similar thing to that of the reference numeral 19 in FIG. 4) and a through hole for inserting the perpendicular plate part of the terminal of the first layer (i.e. the similar thing to that of the reference numeral 22) are formed on the lowest layer of the terminal holder 1. In the example shown in FIG. 1, since the terminals 3 of the lowest layer is for the joint in which a plurality of the clamping end portions 9 are mutually chained with each other, therefore the number of the fixing pieces 12 is small even when the plurality of the clamping end portions 9 are arranged with a narrow pitch and fixing by means of press-fitting is possible.

Thus, since the terminals 4-6 of the respective layers are inserted into the respective through holes 22-24 of the terminal holder 1 without using press-fitting or insert molding method, therefore the terminals 4-6 can be assembled to the terminal holder 1 by using hands of the worker. Of course, the assembling by using an automatic machine is possible.

In the preferred embodiment described above, the example is shown in which an electric connection block is a fuse block for electrically connecting a fuse. However, the present invention can also be applied to a case in which a fusible link or relay is used as the electric component or, alternatively, a mating connector may be an object of the connection instead of the electric component. For example, in a case of a fusible link including a female terminal, as the electric connection terminal, a tab terminal 51 may be used instead of the clamping terminal 9, or in a case of a relay including a male tab terminal, a similar clamping terminal (9) may be used. In a case in which a mating connector including a female terminal is used, a tab terminal may be used. The cover 2 may include chambers each having a size and shape corresponding to such a relay, fusible link or mating connector.

The aforementioned preferred embodiments are described to aid in understanding the present invention and variations may be made by one skilled in the art without departing from the spirit and scope of the present invention.

What is claimed is:

1. An electric connection block comprising:

a plurality of layers, each said layer consisting of a plurality of terminals bent in an L-shape arranged in a line, each said terminal having a first end portion for electric connection and a second end portion for connection to a circuit board;

an electrically insulating terminal holder including receiving surfaces arranged in a stairs manner, each said receiving surface placing a first section of the terminal thereon, and through holes each permitting a second section of each of the plurality of terminals to be inserted therein, said through hole being adjacent to the receiving surface; and a cover which includes a plurality of hole parts through which the respective first sections of each of the plurality of terminals extend and thereby joining the terminal holder; and wherein the hole parts are each arranged and configured to position the first end portions for electric connection of the terminals of the respective layers, so that the first end portions can be smoothly securely connected to respective terminals of electric components such as fuses or relays and to respective terminals of connectors.

2. The electric connection block according to claim 1, wherein the receiving surface is partitioned by partition walls of the terminal holder, a rib is formed crossing the partition wall at a front end of the partition wall, and the first section of the terminal is provided with a concave groove or hole which engages with the rib.

3. The electric connection block according to claim 1, wherein the through hole of the terminal holder and/or the hole part of the cover is formed in a tapered shape so as to gradually become narrow in an insertion direction of the terminal.

4. The electric connection block according to claim 1, wherein a rib, which continues to a partition situated between the hole parts of the cover, engages with a groove part situated at a front end of the rib of the terminal holder.

5. The electric connection block according to claim 1, wherein the first end portions of the terminals are assembled to the terminal holder on a condition that the first end portions are linked by a link belt per layer, wherein the cover is assembled to the terminal holder on a condition that the link belt is cut.

* * * * *